United States Patent [19]

Osawa et al.

[11] Patent Number: 4,972,115

[45] Date of Patent: Nov. 20, 1990

[54] HOT-CATHODE TYPE LOW-PRESSURE RARE GAS DISCHARGE LAMP

[75] Inventors: Takashi Osawa; Seishiro Mitsuhashi; Yujiro Kamano; Katsuo Murakami; Toshihiko Kobayashi; Hiromi Adachi, all of Kanagawa, Japan

[73] Assignee: Mitsubishi Denki Kabushiki Kaisha, Tokyo, Japan

[21] Appl. No.: 343,265

[22] PCT Filed: Aug. 24, 1988

[86] PCT No.: PCT/JP88/00839

§ 371 Date: Apr. 11, 1989

§ 102(e) Date: Apr. 11, 1989

[87] PCT Pub. No.: WO89/02160

PCT Pub. Date: Mar. 9, 1989

[30] Foreign Application Priority Data

Aug. 25, 1987 [JP] Japan ..... 62-210629
Aug. 3, 1988 [JP] Japan ..... 63-193982

[51] Int. Cl.[5] ..... H01J 17/06; H01J 61/52

[52] U.S. Cl. ..... 313/37; 313/491; 313/632

[58] Field of Search ..... 313/37, 491, 631, 632

[56] References Cited

U.S. PATENT DOCUMENTS 4,117,374 9/1978 Witting ..... 313/491 X
4,329,622 5/1982 Corona et al. ..... 313/492 X

FOREIGN PATENT DOCUMENTS 50-38264 8/1975 Japan .

*Primary Examiner*—Sandra L. O'Shea
*Attorney, Agent, or Firm*—Burns, Doane, Swecker & Mathis

[57] ABSTRACT

A hot-cathode type low-pressure rare gas discharge lamp comprises electrodes each of which operate as hot cathode during lighting and which is heated at a temperature ranging from 800° C. to 1200° C., whereby the lamp with an ordinary simple construction can be improved in luminance distribution characteristics, without any loss in life characteristic, and can be put to practical use as an ideal luminous light source for office automation equipment.

1 Claim, 3 Drawing Sheets

HOT-CATHODE TYPE LOW-PRESSURE RARE GAS DISCHARGE LAMP

FIELD OF THE INVENTION

This invention relates to a hot-cathode type low-pressure rare gas discharge lamp comprising electrodes at least one of which operates as a hot cathode during operation of the lamp

BACKGROUND OF THE INVENTION

A discharge lamp for use as a light source for office automation equipment is keenly required to have a uniform luminance over the entire length thereof.

As a prior art relating to improvements of the luminance distribution of the discharge lamp, for instance, Japanese Patent Application Laid-Open (KOKAI) No. 57-11465 (1982) discloses a system in which electrode filament coils are heated into white-incandescence to emit light, thereby compensating for the reduction in luminance which would tend to occur particularly at end portions of the lamp.

In the above-mentioned prior art, however, it is necessary to heat the electrode filaments to a color temperature of 2600° to 3200° K, and, therefore, it is necessary to provide another pair of filament coils for maintaining the life of the lamp, namely, for maintaining the discharge under the heated conditions. Accordingly, the prior art involves an increase in the number of component parts of electrode structure, with the result of a very complicated electrode structure, leading to a complicated manufacturing process and a rise in cost.

DISCLOSURE OF THE INVENTION

It is an object of this invention to provide a hot-cathode type low-pressure rare gas discharge lamp which can prevent the life thereof from shortening, with a non-complicated ordinary electrode structure, can obtain a luminance distribution over the nearly entire length thereof satisfactory for practical use of the lamp as a light source for office automation equipment, and can realize enhanced luminance distribution characteristics.

For attaining the above object, the hot-cathode type low-pressure rare gas discharge lamp according to this invention is characterized in that at least one of electrodes provided at both ends of a glass bulb is heated to a temperature of 800° to 1200° C.

The hot-cathode type low-pressure rare gas discharge lamp of this invention, in which at least one of the electrodes is heated to not lower than 800° C during lighting, is different from a general discharge lamp filled with mercury, in that a favorable discharge condition is obtained between the electrodes provided at both ends of the glass bulb and, in addition, the upper limit of the heating temperature is set to not more than 1200° C., whereby the life of the lamp is securely prevented from shortening. The improvement in luminance distribution and the effect on the life, as mentioned above, have been confirmed by experimental data.

BEST MODE FOR CARRYING OUT THE INVENTION

Figure 1:
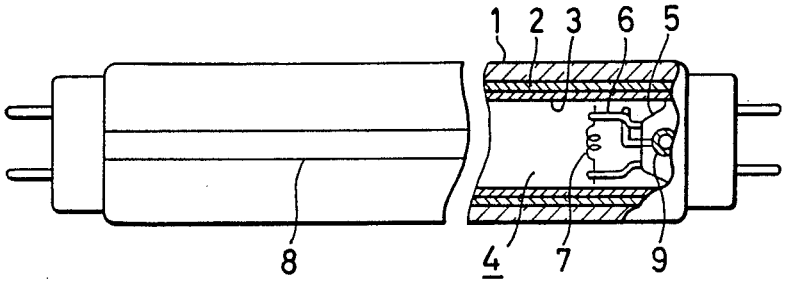
FIG. 1 shows a partially cutaway front view of a hot-cathode type low-pressure rare gas discharge lamp according to one embodiment of this invention.

FIG. 1 shows a partially cutaway view of a hot-cathode type low-pressure rare gas discharge lamp provided with an aperture window portion, according to this invention. In the figure, numeral 1 denotes a glass bulb 15.4 mm in outside diameter and 0.7 mm in wall thickness, and a reflection film 2 is provided on the inner peripheral surface of the bulb 1.

The reflection film 2 is coated with a phosphor layer 3, which comprises a green phosphor $GP_1G_1$, a product by Kasei Optonix, Ltd.

At a common portion of the phosphor layer 3 and the reflection film 2 which extends in the longitudinal direction of the bulb 1, an aperture window portion 8 having a width of 2 mm is provided at which neither the phosphor layer 3 nor the reflection film 2 is provided. The aperture window portion 8 is exposed to the surface of the bulb 1.

A pair of left and right electrodes 4 are provided in the bulb 1, respectively at both ends of the bulb 1 (FIG. 1 shows only one of the electrodes 4).

The electrode 4 comprises a pair of lead wires 6 rooted in a stem 5 which seals gas-tight the end portion of the bulb 1, and a tungsten filament coil 7 jointed to the lead wires 6.

The filament coil 7 is the so-called triple coil obtained by coiling a coiled coil and is coated with an electron-emitting material.

The distance between the electrodes 4 provided at the ends of the glass bulb 1 is set to 260 mm.

The glass bulb 1 is filled with a 10%Xe–90%Ne mixed gas at a pressure of 3 Torr.

At both ends of the interior of the glass bulb 1, getters 9 are respectively provided for adsorbing impurity gas during the life of the lamp, as shown one of the getters in FIG. 1.

The low-pressure rare gas discharge lamp according to one embodiment of this invention, constructed as mentioned above, was turned on by using a 40-KHz sine-wave power source to start a hot cathode operation.

The luminance characteristics of the discharge lamp were determined by experiments.

In the experiments, the low-pressure rare gas discharge lamp and a discharge lamp filled with mercury (hereinafter referred to as the mercury-vapor lamp) were separatedly prepared, and the luminance characteristics of the discharge lamps were compared with each other.

Figure 2:
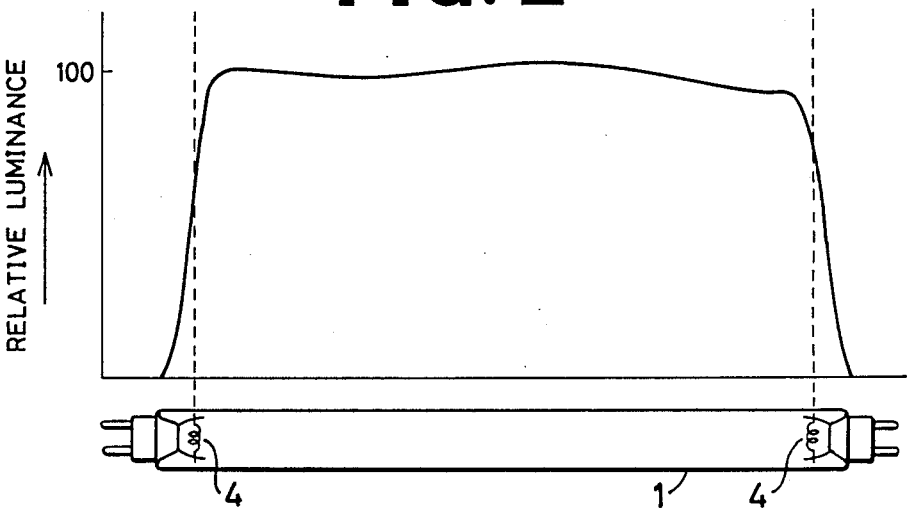
FIG. 2 is a characteristic chart showing the luminance distribution of a mercury vapor lamp.

FIG. 2 shows the luminance distribution of the mercury-vapor lamp, the value of luminance being represented by a value relative to that at the center defined as 100.

As is clear from FIG. 2, the mercury-vapor lamp has a uniform luminance distribution over a substantially entire region of a central portion of the glass bulb 1, though the luminance is sharply declined in each outer region from near the center of the electrode 4 toward the end of the bulb 1. This tendency remained unchanged, though not particularly shown in the figures, irrespective of whether the filament coils 7 of the electrodes 4 were heated to a temperature of not lower than 800° C. or not heated.

Figure 3:
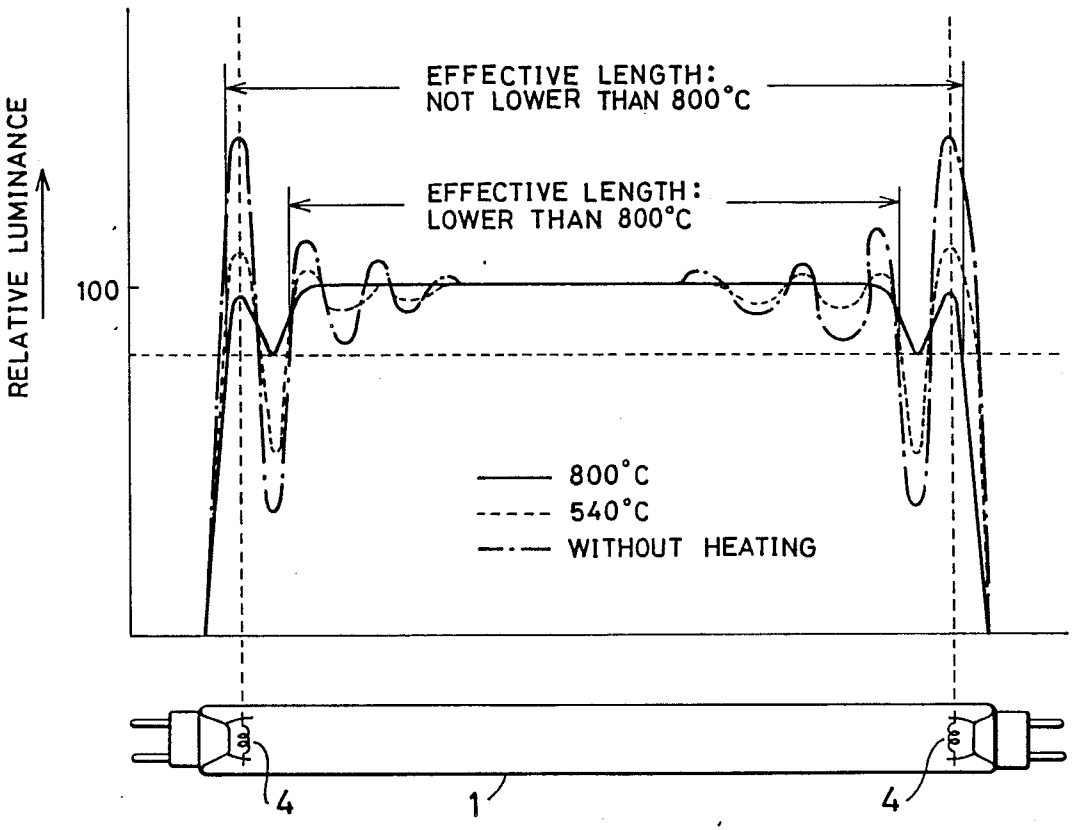
FIG. 3 is a characteristic chart showing the luminance distribution of the lamp according to this invention.

FIG. 3 shows the luminance distribution of the low-pressure rare gas discharge lamp according to one embodiment of this invention, the value of luminance being represented by a value relative to that at a central portion defined as 100, in the same manner as in FIG. 2. In FIG. 3, the luminance distribution in the case of heating the filament coils of the electrodes 4 to 800° C. is represented by the solid line, while the luminance distribution in the case of heating the filament coils to 500° C. is represented by the dotted line, and the luminance distribution in the case of not heating the coils is represented by the dot-and-dash line. The luminance distributions all have the same tendency as that in the case of the mercury-vapor lamp shown in FIG. 2, in that the luminance is sharply declined from the position of each electrode 4 toward the end portion of the bulb 1. FIG. 3, however, shows a wavy luminance fluctuation which reaches a maximum crest in the vicinity of each electrode 4 and is gradually damped from the electrode 4 toward the center of the bulb 1. Thus, there is a large difference in distribution characteristics, between the luminance distribution of the mercury-vapor lamp shown in FIG. 2 and the luminance distributions of the low-pressure rare gas discharge lamp shown in FIG. 3. The wavy luminance fluctuation in FIG. 3 is depressed variations in wave height as the filament temperature becomes higher. The length of the central part of the glass bulb 1 extending between the points at which a 20% reduction in luminance, based on the luminance at the central portion, appear for the first time will now be defined as an "effective width". Then, the effective width is extended further to near the bulb end over the filaments when the filament temperature of the electrodes 4 is not lower than 800° C. When the filament temperature is less than 800° C., on the other hand, the effective width is smaller than the distance between the electrodes 4, resulting in an obstacle in practical use of the lamp.

It is thus clear that the luminance distribution is improved when the filament coils of the electrodes 4 are heated to not lower than 800° C. However, when the heating temperature for the filament coils exceeded 1200° C., evaporation of the electron-emitting material became conspicuous, resulting in shortening the life of the lamp.

Based on the experimental results as mentioned above, according to this invention, the heating temperature for the electrodes during lighting is set in a range from 800° C. to 1200° C., and this setting is the most characteristic feature of the invention.

Figure 4:
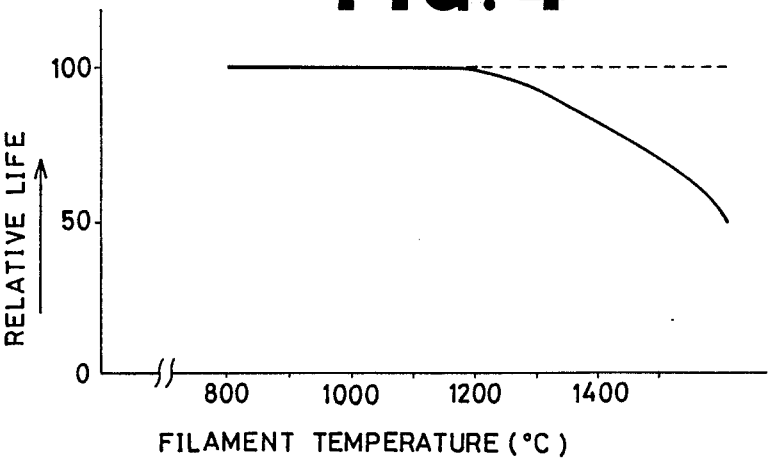
FIG. 4 is a characteristic chart showing the relationship between filament temperature and lamp life.

FIG. 4 shows the relationship between filament temperature of electrodes and life based on the abovementioned experimental results, the life being represented by a value relative to that at a filament temperature of 800° C. defined as 100. In this case, the filaments of the electrodes were constantly heated, and the lamp was operated in a 2-min lighting cycle with an ON time of 1 min and an OFF time of 1 min. The life was determined as the actual lighting time ended when the lamp failed to be turned ON. The experimental results clearly show that a filament temperature exceeding 1200° C. shortens the life, and is therefore undesirable.

In the above embodiment, the luminance distribution and the life in relation to the filament temperature have been described in the cases where the low-pressure rare gas discharge lamp was lit by a 40 kHz AC. The present inventors have confirmed, also, that the same effects as above are obtainable even when the low-pressure rare gas discharge lamp is lit by a DC.

Figure 5:
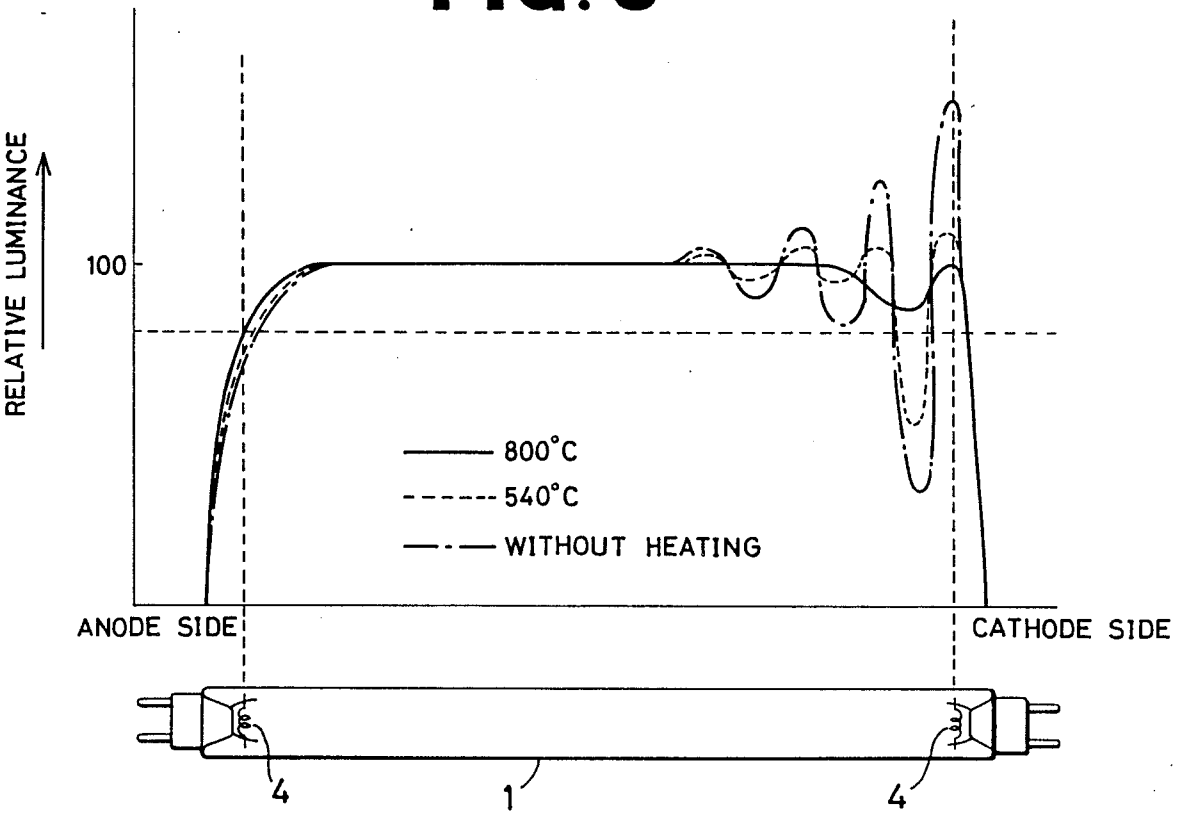
FIG. 5 is a characteristic chart showing the luminance distribution of a lamp when the lamp is lighted by a direct current.

FIG. 5 shows the results of measurement of the luminance distribution in the case where the low-pressure rare gas discharge lamp of the above embodiment was lit by a DC at a bulb voltage of 80 V. In this case, both ends of the electrode filament of an electrode were short-circuited, and this electrode was used as an anode without heating. The other electrode was used as a cathode by heating to 540° C. or 800° C., in the same manner as in the above-mentioned embodiment. In this way, the luminance distribution was measured.

As is clear from the results of measurement, also in the case of DC lighting, the disorder of the luminance distribution at bulb end portions during lighting depends on temperature of the electrode, and corresponds to a plurality of dark spaces generated between the electrode and the positive column while the electrode operates as a cathode.

The same phenomenon was observed also when, as an anode, a simple electron-receiving means without heating means, such as a tungsten rod generally used as a cold cathode, was used in place of the filament.

Besides, an effect of improving the luminance distribution is observed when the filament temperature is set to not lower than 800° C. during lighting. Therefore, when the filament temperature is raised to not lower than 800° C. by heating prior to the start of lighting, an improved luminance distribution is obtainable immediately after starting the lamp. Since it is an object of this invention to obtain a discharge lamp suitable for use as a light source for office automation equipment, it may be said that the mercury-vapor lamp mentioned with reference to FIG. 2 is also effective, from the viewpoint of luminance distribution characteristics.

The mercury-vapor lamp, however, is slow in rise (starting) and have other problems in that the lamp is susceptible to the ambient temperature, and so on. Thus, the mercury-vapor lamp has been excluded from this invention.

Moreover, though the above-mentioned embodiment has been described with reference to the electrode 4 comprising the filament coil, the same effects as above are expectable with indirectly heated type, sintered type or other types of electrodes which do not comprise the filament coils.

INDUSTRIAL APPLICABILITY

As has been described above, the hot-cathode type low-pressure rare gas discharge lamp according to this invention has an electrode temperature set in the range from 800° C. to 1200° C. by heating during lighting. Therefore, the discharge lamp of the invention, with an ordinary simple lamp structure, is capable of showing improved luminance distribution characteristics without any loss in life characteristics, and is suitable for use as a luminous light source for office automation equipment.

What is claimed is:

1. A hot-cathode type low-pressure rare gas discharge lamp comprising:

a glass bulb filled with a rare gas, light generated by this rare gas being converted by a fluorescent material into a desired visible light; and a first electrode arranged at one end of said glass bulb and a second electrode arranged at an other end of said glass bulb, said first and second electrodes operating as cathodes during operation of said lamp, each of said first and second electrodes including a filament, the entire filament being heated to a temperature of more than 800° C. and less than 1200° C. at least when said first and second electrodes operate as hot-cathodes during lighting.

* * * * *